United States Patent [19]

Roe

[11] 4,233,781

[45] Nov. 18, 1980

[54] WINDOW ASSEMBLY FOR SOCKET WINDOW

[75] Inventor: Norman E. Roe, Sierra Madre, Calif.

[73] Assignee: Hehr International, Inc., Los Angeles, Calif.

[21] Appl. No.: 895,384

[22] Filed: Apr. 11, 1978

[51] Int. Cl.[2] ..... E06B 1/04

[52] U.S. Cl. ..... 49/504; 160/91; 49/413

[58] Field of Search ..... 49/504, 505, 413, 501; 160/91; 52/213

[56] References Cited

U.S. PATENT DOCUMENTS

| | | | |
|---|---|---|---|
| 3,087,537 | 4/1963 | Levan | 49/413 X |
| 3,808,742 | 5/1974 | Ehret et al. | 160/91 X |
| 4,042,004 | 8/1977 | Kwan | 160/91 |

FOREIGN PATENT DOCUMENTS

| | | | |
|---|---|---|---|
| 2339731 | 8/1977 | France | 49/504 |
| 965287 | 7/1964 | United Kingdom | 49/413 |

*Primary Examiner*—Philip C. Kannan
*Attorney, Agent, or Firm*—Reed C. Lawlor

[57] ABSTRACT

A window assembly is mounted in a socket window opening of a motor vehicle with the interior side of the window frame substantially coplanar with the body flange in the window opening and the exterior side of the assembly. The window assembly is secured in place by means of self-tapping screws or other fasteners that extend through perforations in the window frame in the body flange into the window frame. In the best embodiment of the invention a stationary window and a sliding window are mounted wholly within the space forming the socket and substantially the entire window frame is also mounted within the socket.

5 Claims, 13 Drawing Figures

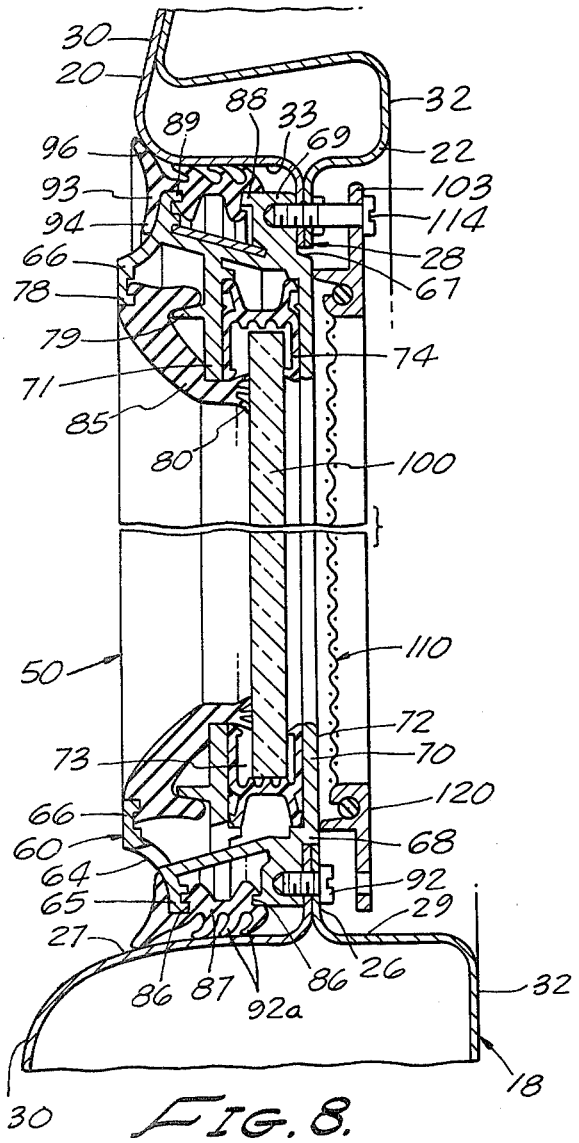
FIG. 8.
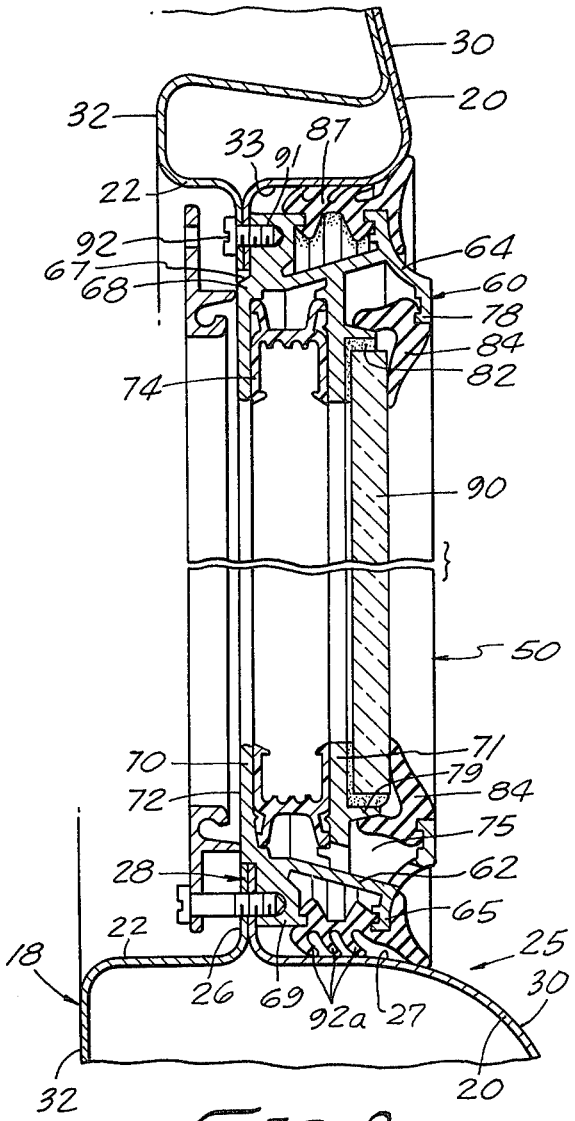
FIG. 9.
FIG. 10.
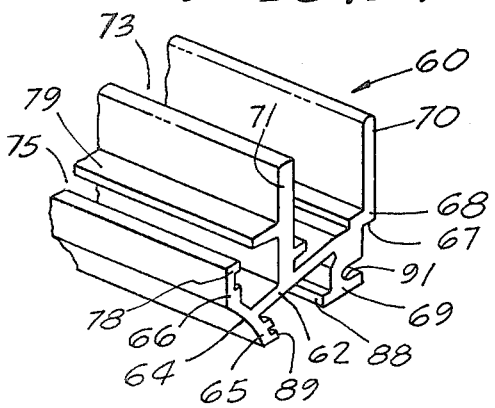
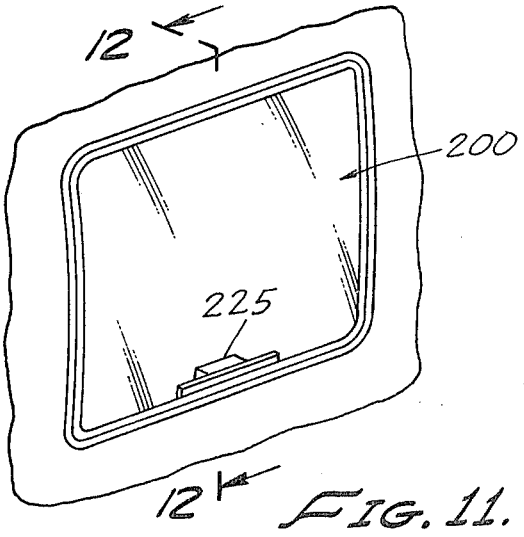
FIG. 11.

WINDOW ASSEMBLY FOR SOCKET WINDOW

INTRODUCTION

This invention relates primarily to window structures for motor vehicles such as recreational vehicles commonly called vans. The invention relates more particularly to window assemblies mounted in window openings of the socket type formed in the exterior walls of the bodies of such vehicles or other housing structures such as travel trailers. Though not limited solely thereto, the invention will be described particularly with reference to motor vehicles.

In many motor vehicles, the window openings are formed in walls which are made of two sections of sheet metal which are brought together to form body flanges in the window openings between the external and internal surfaces of the walls. Typically, stationary windows are mounted in those walls and are supported on the flanges by means of gaskets composed of vinyl or other rubber-like material. Such windows are difficult and costly to install when using such a gasket-type mounting. Furthermore, such a mounting arrangement in unsuitable for use with sliding windows and awning windows that provide for adjustable ventilation. More particularly, such gasket-type seals are likely to develop air and water leaks when such windows are adjusted to change ventilation.

Such window openings are said to be of the socket type, inasmuch as they have a recess on at least one side of the body flange.

The principal object of this invention is to provide a new arrangement for mounting adjustable windows in such socket-type walls which are easier to install and are more secure after installation.

Another object of the invention is to provide an improved window of the type mentioned which is readily opened to provide ventilation, while preserving its ability to seal against air and water leakage when closed.

Another object of the invention is to provide an improved sliding window for socket mounting.

Still another object of the invention is to provide a sliding window which is entirely or almost entirely contained in the opening between the internal and external surfaces of the vehicle wall.

A further object of the invention is to provide an easily installed sliding window that is of the socket type which is substantially free of external projections.

Another object of the invention is to provide an openable window of the socket-mounting type in which the innermost surface of the window assembly is substantially coplanar with the flange of the window opening.

At the outset it is to be recognized that most, if not all, of the parts of the window structure of this invention has probably appeared before in one place or another and some of them have appeared in combination. This invention is believed to involve new combinations of various features as set forth in the claims.

DESCRIPTION OF THE DRAWINGS

The foregoing and various additional objects, features, and advantages will be set forth hereinafter in connection with a detailed description of the invention in connection with the accompanying drawings.

FIG. 8 is a sectional view taken on the vertical plane 8—8 of FIG. 4;

FIG. 9 is a sectional view taken on the vertical plane of 9—9 of FIG. 4;

FIG. 10 is a fragmentary view of the metal extrusion forming the window frame;

FIG. 11 is a perspective view of part of an awning window embodying some of the features of this invention mounted on a vehicle wall;

DETAILED DESCRIPTION

Figure 1:
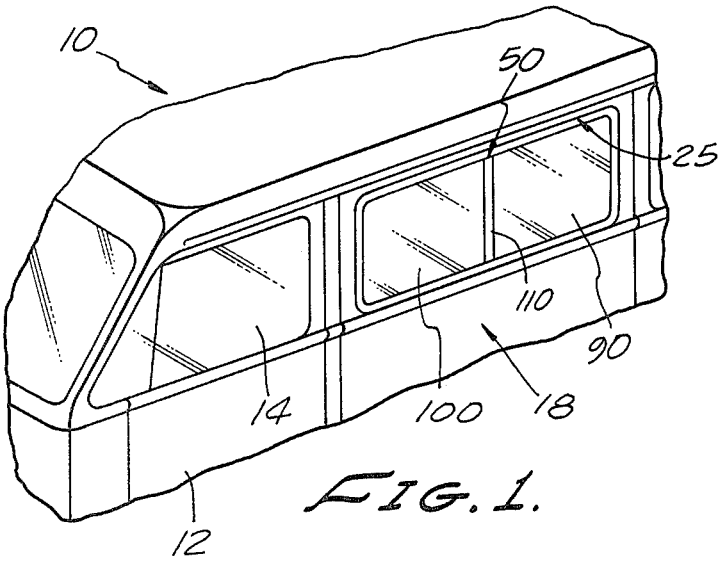
FIG. 1 is a perspective view of a portion of a recreational vehicle in which this invention has been embodied.
Figure 2:
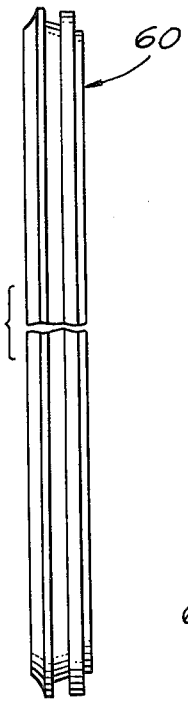
FIG. 2 is an elevational view of an assembly of a flat window comprising the first embodiment of the invention illustrated in FIG. 1.

In FIG. 1 there is illustrated a portion of a closed recreational vehicle 10 in which a flat window 50 has been installed in accordance with the present invention. In this particular vehicle a door 12 is provided that has a conventional window 14 that is vertically movable within a space between the inner and outer surfaces of the door. The vehicle 10 is also provided with a stationary wall section that is provided with a socket-type opening 25 in which the window assembly 50 of this invention has been installed.

Figure 5:
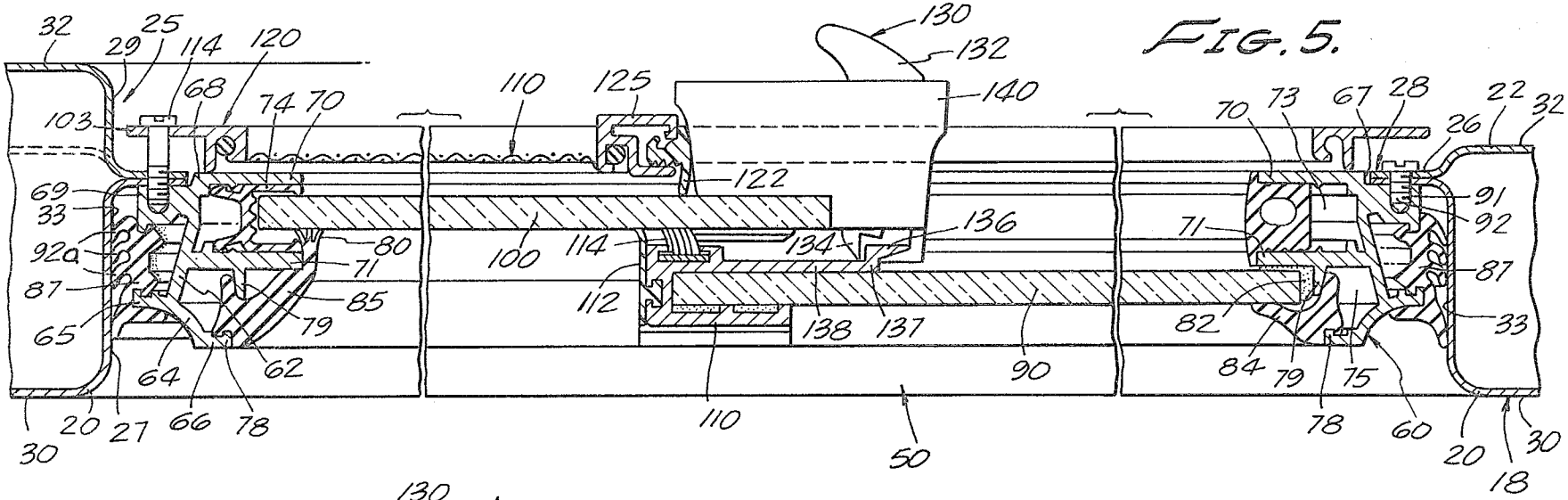
FIG. 5 is a sectional view taken on the horizontal plane 5—5 of FIG. 4.

As shown in FIGS. 5, 8, and 9, the stationary wall 18 is formed of two flat pieces of sheet metal 20, 22 which have been shaped with flat flanges which abut each other and are welded together to form a flat body flange 28 which extends inwardly of the window opening. The body flange is located intermediate the exterior surface 30 and the interior surface 32 of the body wall, being located more closely to the interior surface 32 than to the exterior surface 30. With this arrangement a deep socket 27 is formed on the exterior side of the body flange and a shallow socket 29 is formed on the interior side of the body flange.

In the window opening described, the outer space between the body flange 28 and the external wall surface 30 constitutes a socket into which the window of this invention is fitted when it is installed in place in the vehicle. The terms "exterior" and "interior" as used herein, refer to the exterior of the recreational vehicle and the interior of the recreational vehicle, as the case may be. The terms "outwardly" and "inwardly", on the other hand, usually refer to the radial directions within the window opening in which the window assembly is installed. Thus, the term outwardly refers to the direction between the surfaces of the vehicle wall extending away from the center of the window opening toward the body flange and the socket surface, and the term inwardly refers to the direction between the surfaces of the wall extending away from the socket surface toward the center of the window opening. These terms are applied to the window assembly 50, as if it were mounted in place in the vehicle wall.

In accordance with this invention, a sliding window assembly 50 is provided which lies substantially entirely between the exterior surface 30 and the interior surface 32 of the body wall 18.

The window assembly 50 comprises a window frame 60, a stationary glass window panel 90, and a sliding glass window panel 100. Optionally it may include a bug-screen 110 mounted in a screen frame 120 which in turn is mounted in the interior part of the window assembly 50 opposite the sliding window panel 90. The sliding window 100 may be moved horizontally in conventional manner from a closed position to an open position or in the reverse direction. The window assembly also includes a window operator 130 to facilitate locking the sliding window in closed position.

It will be noted in FIGS. 5, 8, and 9 that the window panels 90 and 100 lie substantially entirely within the deep socket 27 that is between the body flange 28 and the external wall surface 30. It will also be noted that the entire window structure lies substantially entirely within the space between the inner surface 32 and the external surface 30 of the vehicle wall surrounding the window aperture. The only exceptions are the window latch 130 as shown in FIG. 5 and the upper part of the window frame and associated sealing elements as indicated in FIG. 8. With this arrangement there is minimum obstruction of the passenger space within the vehicle and practically no projection of any parts beyond the external surface 30 of the body wall. Thus, there is practically no obstruction to passing people or vehicles on the external side of the body wall, particularly inasmuch as the entire window assembly 50 lies on the interior side of the external surface 30 that itself lies at the lower portion of the body wall adjacent the window opening. Likewise there is minimum obstruction to movement of passengers within the vehicle.

The window frame 60 is of a unitary rectangular structure, being extruded from some easily worked material such as an aluminum alloy. It is formed in one piece, and shaped to fit the socket, and the ends are fastened securely together by some such process as that described and claimed in Oiler U.S. Pat. No. 3,981,067. The frame 60 is of generally rectangular configuration but with radius corners. By this is meant that the inner sides of the corners are curved, as are also the outer sides.

The frame 60 includes a web 62, formed at its perimeter, and having four sections adjacent to and extending substantially parallel to the respective sides of the window opening. The various sections of the perimeter wall on all four sides and at the corners diverge outwardly slightly at an angle of about 15° relative to the axis perpendicular to the plane of the window frame.

As indicated in FIG. 5, an external trim, or flange, member 64 comprises an outwardly extending flange 65 and an inwardly extending flange 66. Likewise the interior trim, or flange, member 68 comprises an outwardly extending flange 69 and an inwardly extending flange 70. An additional central flange 71 between the two inner flanges 66 and 70 extends inwardly from the perimeter section 62 thus providing an exterior channel 75 for the external stationary window panel 90 and an interior channel 75 for the sliding window panel 100.

Removable glide tracks, such as track 74, are provided on all four sides of the exterior channel 75 to support and guide the sliding window panel 100.

As indicated in FIGS. 5 and 9 an L-shaped cushion 82 and a glazing seal 84 that is locked between a ledge 78 on the external inner flange 66 and a shelf 79 on the central flange 71 seal the outer edges of the stationary window 90 and hold this window 90 fixed in position in the window frame. As indicated in FIGS. 5 and 8, a window sealing bead 85 is mounted at the outermost edges of the sliding window 100 between the ledge 78 and the shelf 79 of the inner flanges 66 and the central flange 71. The innermost edge of the sealing bead 85 is provided with resilient splines 80 that are pressed into sealing contact with the slidable wall panel 100.

A socket sealing bead member 87 that encircles the window frame is employed to provide a seal between the window frame and the surface 33 of the external socket 27. The sealing member 87 is gripped between the outer flanges 65 and 69 (See FIG. 5), being formed with two grooves 86, 88 for tightly gripping ledges 88 and 89 at the outermost edges of the outer flanges. The socket sealing member 87 is formed with three outwardly extending splines **92*a* that contact and are squeezed into sealing relationship with the socket surface 33 when the window is installed in place. It is also provided with an external T-shaped sealing section 93 having an inner arm 94 that is sealed against the external surface of the outer flange 69 and an outer arm 96 that contacts the socket surface 33 when the window is pressed into place in the socket 27, as indicated in FIG. 8**.

The space between the outer flanges 65 and 69, the web 62, and the sealing member 87 is empty. Slight leakage between the socket sealing member 87 and the flanges 65 and 69 prevents excessive differential pressure from developing across the seal 87.

A mullion assembly 110, which may be of conventional type, and a window latching assembly 130, which may also be of conventional type, are mounted respectively at the innermost edges of the stationary window panel 90 and the sliding window panel 100 to facilitate locking the window panels together when the sliding window 100 is in closed position. One type of such a mullion and latching assembly is illustrated in Kwan U.S. Pat. No. 4,042,004. The present locking arrangement is somewhat different. The mullion 110 is of U-shaped configuration and extends along the inner edge of the stationary window 90 to rigidify the edge to avoid breakage when the two window panels are locked together. A mullion seal 112 made of compressible material such as rubber, is secured to mullion 110 along its entire vertical edge to seal the gap between the stationary and the slidable glass panels 90 and 100. Weather stripping 114 is also secured to the mullion 110 in the gap between the two window panels throughout their height to seal the gap against air and water leakage between overlapping parts of the windows.

Figure 7:
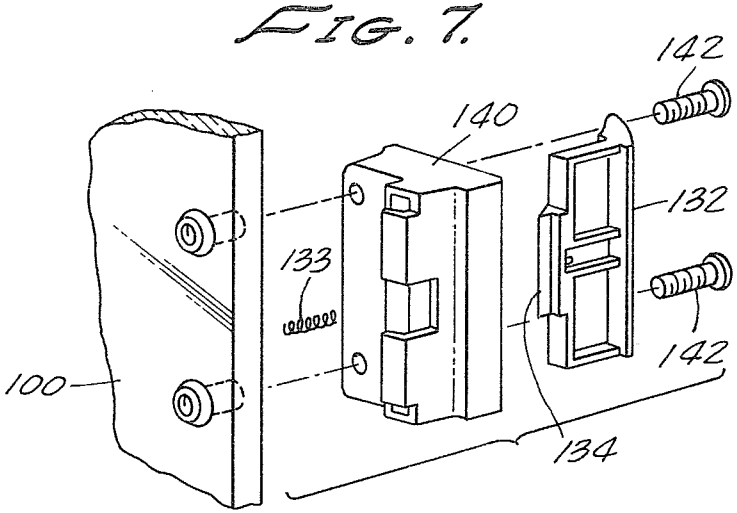
FIG. 7 is an exploded view showing parts of the window latching mechanism.
Figure 6:
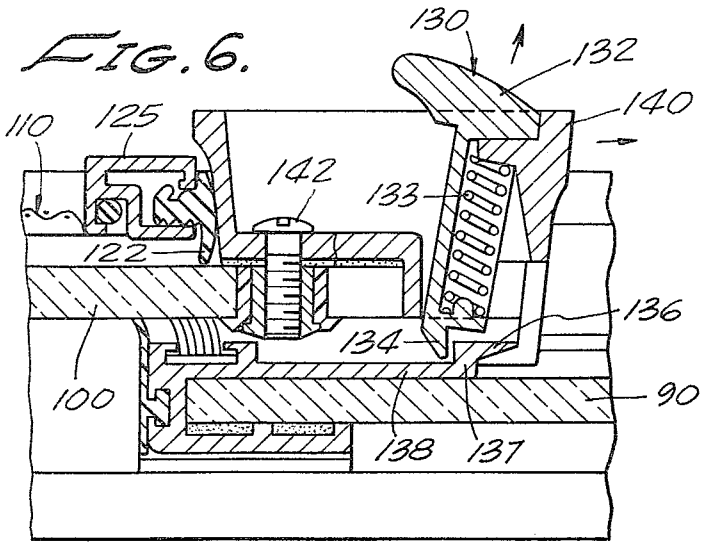
FIG. 6 is a cross-sectional view taken on the horizontal plane 6—6 of FIG. 4.

As indicated in FIGS. 6 and 7, the latch assembly 130 comprises a latch 132 which is adapted to be pulled toward the interior of the vehicle to release the sliding window when desired. The latch housing 140 is suitably secured by means of a bolt 142 to the inner edge of the sliding window 100. When pulled against the preloaded compression spring 133, the movable latch finger 134 is raised to release it from the stationary latch member 136 that is located at the outer edge 137 of the inner leg 138 of the mullion and projects away from the stationary window panel 90 toward the interior of the vehicle.

To install the window assembly in the window opening, the window assembly is pushed into the outer socket 27 of the wall and then mounted securely in place. The interior flange member 68 is provided with a step 67 around the entire window frame to facilitate mounting the window frame flush against the body flange 28 and with the interior part of the window frame projecting through the opening in the body flange to locate the interior surface 72 of the flange 70 flush with the interior surface 27 of the body flange. To establish this flush mounting the interior flange member 68 is provided with the step 67 with the interior inner flange 70 offset from the interior outer flange 69 toward the interior side of the window assembly by the thickness of the body flange 28.

The body flange will have been perforated previously at a number of points surrounding the window opening to receive simple fastening means, such as screws, on all sides of the opening.

To facilitate securing the window frame in place in the socket, in accordance with this invention a screw slot 91 is formed in the outer flange 69 on the interior side of the window frame and self-tapping screws 92 are screwed through perforations formed in the body flange 28 and into that slot 91.

As the window assembly is pushed into the socket the sealing splines 92*a* and the outer arm 96 of the T-shaped section of the socket seal 87 are bent and squeezed against and into the inner socket wall 27 to provide a firm airtight, water-tight seal between the window frame and the socket wall.

With the arrangement described above the window assembly is mounted substantially entirely in the space provided by the socket. All but the uppermost part of the window assembly is located entirely within the space provided by the external surface of the body wall and the body flange at the lower part of the window opening. At the same time there is minimum obstruction of the passenger space on the interior of the vehicle body.

If desired, a bug screen 110 may be mounted on the interior side of the body flange, to screen out bugs and the like when the movable window 100 is in its open position. The screen 110 may be mounted in a screen frame 120. The screen frame may be provided with a peripheral flange member which projects on three sides against the interior flange 70 of the window frame when mounted in place and it may be secured in place by means of self-tapping screws 114 that project through an outer flange member 103 and through perforations in the body flange 28 into the same screw slot 91 as the screws 92. A screen mullion 125 is secured to the upper and lower members of the screen frame so as to confine the screen to the part of the window opening that is opposite the space which is opened when the window 100 is moved to its open position and to support a vertical seal 122 that engages the interior surface of the sliding window 100.

Figure 3:
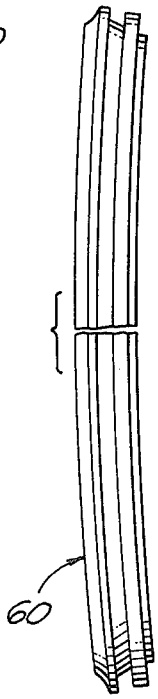
FIG. 3 is an elevational view of a similar window having a curved profile adapted to fit a vehicle having a wall that is curved about a somewhat horizontal axis.
Figure 4:
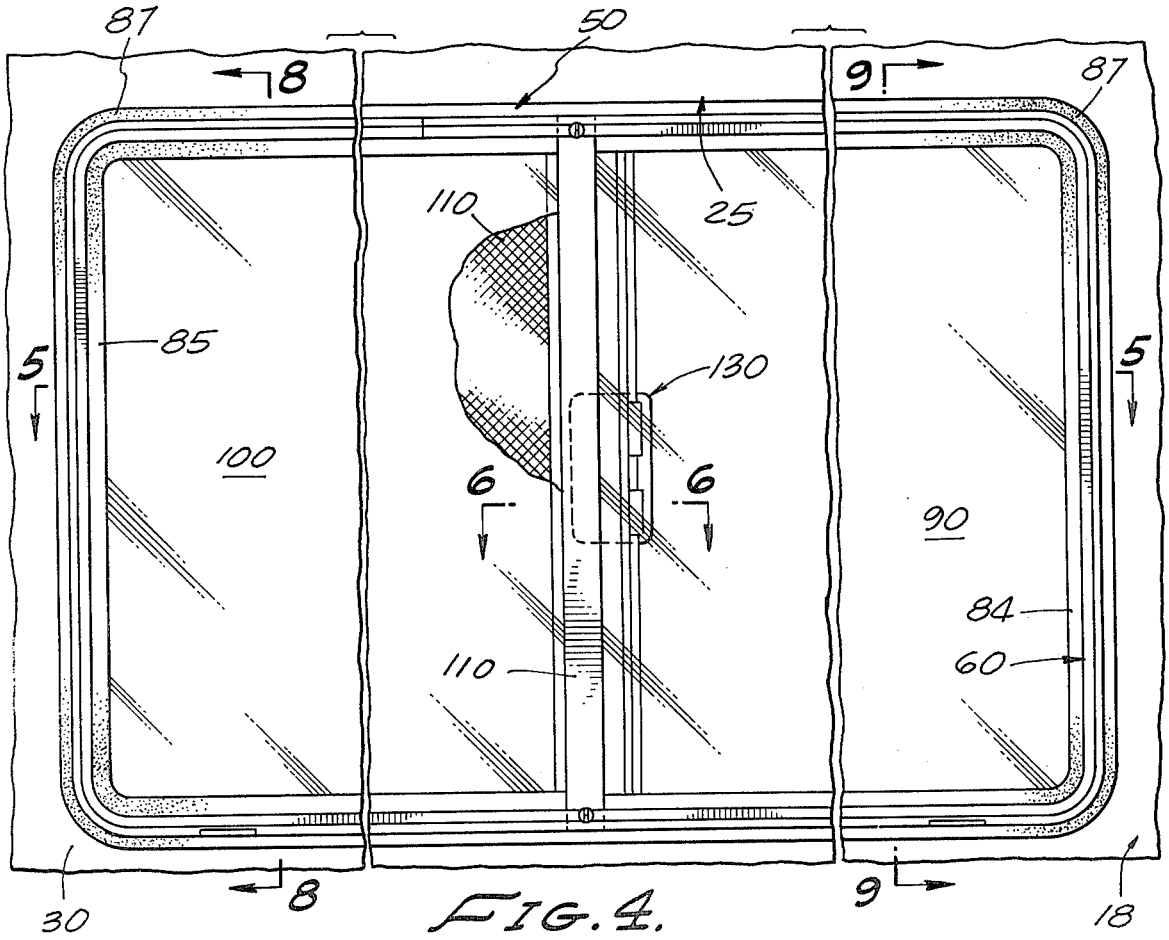
FIG. 4 is an elevational view, partly fragmentary, of a flat window embodying this invention.

The invention has been described above with reference to its application to a motor van which has flat side walls. It will be understood, however, that the invention may be applied to motor vans with curved side walls. In this case the window is shaped as indicated, for example, in FIG. 3 to fit the contour of the motor vehicle.

Figure 12:
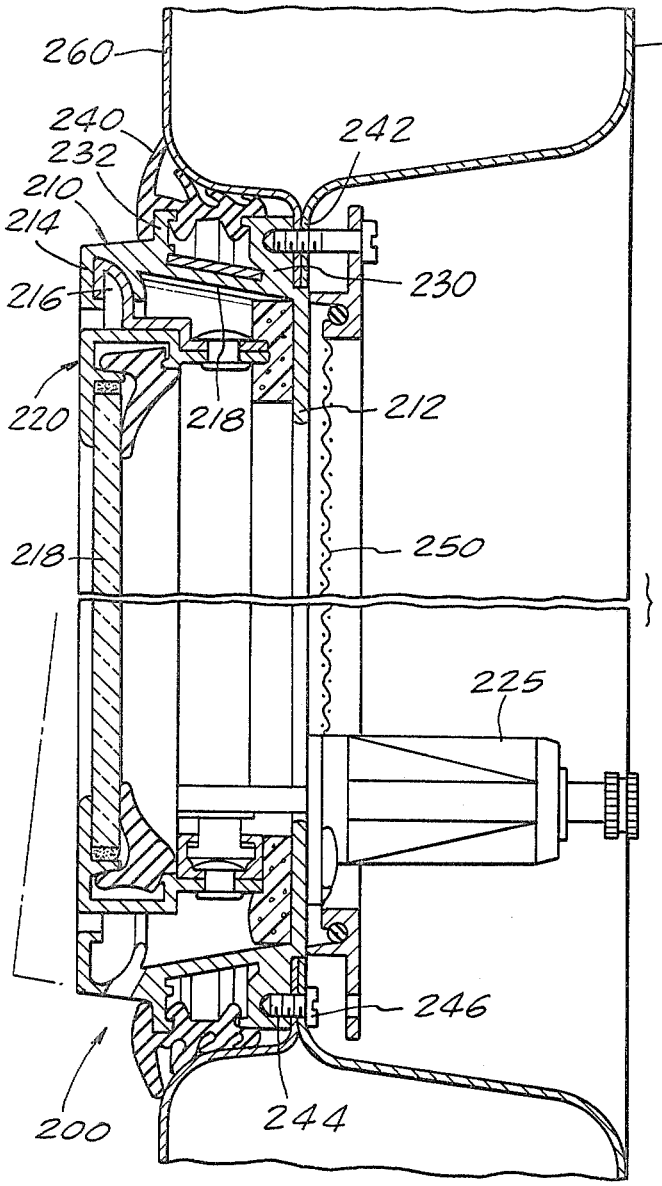
FIG. 12 is a sectional view taken on the vertical plane 12—12 of FIG. 11.
Figure 13:
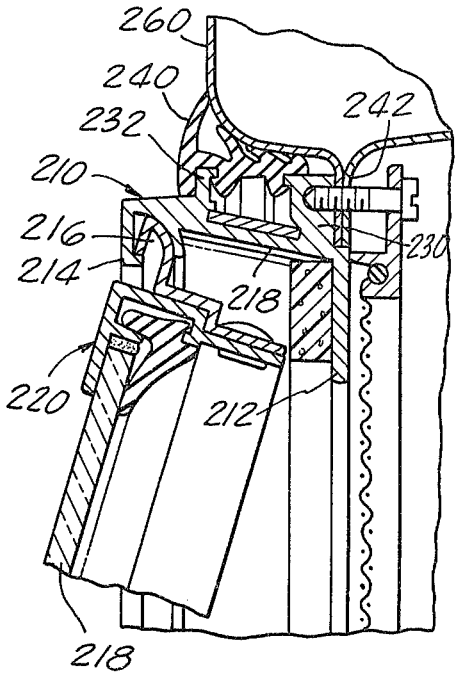
FIG. 13 is a sectional view used in illustrating the hinge action of the window of FIG. 11.

Some of the features of this invention are applicable to window structures other than that described above. The awning window illustrated in FIGS. 11, 12, and 13 embodies many of the features of the present invention, but not all of them. The inner side of the window frame 210 differs substantially from the inner side of the frame 60 of the embodiment of the invention described above. More particularly, it includes only two flanges 212 and 214 that project inwardly from the web 218. The external flange 214 is provided with a hinge structure 216 to facilitate mounting of a window 218 in a frame 220 hinged for swinging movement about a horizontal pivot 216 located at the upper end of the frame 210. A window operator 225 is provided to permit angular adjustment of the window about the pivot 216.

The remainder of the window frame 210 is very similar to that previously described. It includes an interior flange 212 substantially the same as that previously described and also two outer flanges 230 and 232 and window seal 240 similar to that previously described. And the window frame 210 is secured to the body flange 242 by means of self-tapping screws 246 that project through the body flange and engage a screw slot 244 that surrounds the window frame 210, and that is formed in the flange 230 as previously described. Likewise, a bug screen 250 may be optionally mounted on the interior side of the window as previously described. But in this case the bug screen covers the entire area of the window aperture.

In this particular case the body flange is located more closely to the exterior surface 260 of the vehicle wall than it is to the inner interior surface 262 thereof, in order to accommodate the bulkier window operator 225. As a result, the T-shaped portion of the window seal has a convex instead of a concave configuration. The seal 240 of the awning window 200 is substantially identical with the sealing member 85 of the sliding window of the first embodiment of the invention. The sealing member serves to provide an excellent airtight, watertight seal around the periphery of the window frame in either arrangement.

It is thus seen that this invention provides for a window assembly which may be easily mounted in a wall structure of the socket type and which in all embodiments provides for minimum obstruction of the space within the vehicle or other housing structure, and, when the window is mounted in a deep socket also provides for minimum obstruction on the exterior surface of the wall.

The invention claimed is:

1. In combination with a housing structure having a window opening formed in a wall thereof with a body flange projecting inwardly toward the central portion of the window opening and forming a socket having a wall surface between said body flange and the external surface of the structure, a window frame having a peripheral web, said frame being provided with an interior flange and an exterior flange extending inwardly from said web toward the central portion of said window opening, said web and said inwardly extending flanges being arranged to support window panel structure within said frame, said frame also being provided with an interior flange and an exterior flange extending outwardly from said web away from said central portion of said window opening, said frame having an interior flange section comprising said two interior flanges and an exterior flange section comprising said two exterior flanges, means securing said interior flange section of said frame directly to said body flange;

means securing window panel structure on said frame and supporting said window panel structure on the exterior side of said body flange; and sealing means extending outwardly from the outer side of said web into engagement with said socket surface for sealing the space between said window frame and said socket surface;

the interior surface of said inwardly extending interior flange being offset toward the interior of said structure from the interior surface of said outwardly extending interior flange and being substantially coplanar with the interior surface of said body flange.

2. In combination with a housing structure having a window opening formed in a wall thereof with a body flange projecting inwardly toward the central portion of the window opening and forming a socket having a wall surface between said body flange and the external surface of the structure, a window frame having a peripheral web, said frame being provided with an interior flange and an exterior flange extending inwardly from said web toward the central portion of said window opening, said web and said inwardly extending flanges being arranged to support window panel structure within said frame, said frame also being provided with an interior flange and an exterior flange extending outwardly from said web away from said central portion of said window opening, said frame having an interior flange section comprising said two interior flanges and an exterior flange section comprising said two exterior flanges, the interior surface of said inwardly extending interior flange being offset toward the interior of said structure from the interior surface of said outwardly extending interior flange;

means securing said interior flange section of said frame directly to said body flange;

means securing window panel structure on said frame and supporting said window panel structure on the exterior side of said body flange; and sealing means between the outer side of said web and said socket surface for sealing the space between said window frame and said socket surface.

3. In the combination set forth in claim 2 wherein said interior surface of said inwardly extending interior flange is substantially coplanar with the interior surface of said body flange.

4. In combination set forth in claim 2 wherein said securing means is provided by a screw slot formed in said outwardly extending interior flange on the interior surface of said window frame and self-tapping screws extending through said wall flange from the interior side thereof into said slot.

5. In combination with a housing structure having a window opening formed in a wall thereof with a body flange projecting inwardly toward the central portion of the window opening and forming a socket having a wall surface that slopes and diverges outwardly between said body flange and the external surface of the structure, a window frame having a peripheral web, said frame being provided with an interior flange and an exterior flange extending inwardly from said web toward the central portion of said window opening, said web and said inwardly extending flanges being arranged to support window panel structure within said frame, said frame also being provided with an interior flange and an exterior flange extending outwardly from said web away from said central portion of said window opening, said frame having an interior flange section comprising said two interior flanges and an exterior flange section comprising said two exterior flanges;

means securing said interior flange section of said frame directly to said body flange;

means securing window panel structure on said frame and supporting said window panel structure on the exterior side of said body flange; and sealing means between the outer side of said web and said socket surface for sealing the space between said window frame and said socket surface, said sealing means comprising a rubber-like member secured between the outer ends of said outer flanges and extending outwardly therefrom, said rubber-like member being formed with outwardly extending splines that engage said sloping and diverging wall surface of said socket, said sealing means comprising an inwardly extending spline pressed against the outer surface of the outer exterior flange.

* * * * *